US006464116B1

(12) United States Patent
Hanse

(10) Patent No.: US 6,464,116 B1
(45) **Date of Patent: *Oct. 15, 2002**

(54) STOPPER ROD

(75) Inventor: Eric Hanse, Rosselin (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/856,280

(22) PCT Filed: Nov. 16, 1999

(86) PCT No.: PCT/BE99/00144

§ 371 (c)(1),
(2), (4) Date: May 18, 2001

(87) PCT Pub. No.: WO00/30785

PCT Pub. Date: Jun. 2, 2000

(30) Foreign Application Priority Data

Nov. 20, 1998 (BE) ..... 9800838
Nov. 20, 1998 (BE) ..... 9800839

(51) Int. Cl.[7] ..... B22D 41/08
(52) U.S. Cl. ..... 222/602; 222/597

(58) Field of Search ..... 222/597, 602, 222/603

(56) References Cited

U.S. PATENT DOCUMENTS 4,946,083 A 8/1990 Fishler et al.
5,024,422 A 6/1991 Fishler et al.
6,367,671 B1 * 4/2002 Hanse et al. ..... 222/602

FOREIGN PATENT DOCUMENTS

DE 4040189 C1 1/1992

* cited by examiner

*Primary Examiner*—Scott Kastler
(74) *Attorney, Agent, or Firm*—James R. Williams

(57) ABSTRACT

The present invention concerns a stopper rod whose gas tightness and rigidity are improved. In particular, the stopper rod of the present. invention has means for maintaining the compression of the sealing gasket (11, 11') in contact with the annular sealing surface (10) of the body of refractory material when the stopper rod is brought to a high temperature. According to one embodiment of the invention, these means are furnished by a sleeve (12) comprised of a material with a high coefficient of thermal expansion, the dilatation of which maintains the sealing gasket under compression when the stopper rod is brought to a high temperature.

15 Claims, 1 Drawing Sheet

STOPPER ROD

The present invention concerns a new stopper rod for regulating the flow of a molten metal from a pouring group, for example, steel or cast iron, from a distributor or a casting ladle, and more particularly a one-piece stopper rod that has means for attachment to a lifting mechanism. In a particular embodiment, the stopper rod has also means for introducing an inert gas, such as argon, into the molten metal bath during continuous casting operations.

Such a stopper rod and its use are well known to the skilled artisan, in particular by U.S. Pat. Nos. 4,946,083 and 5,024,422 to which reference is made. Among others, these documents describe a one-piece stopper rod that can be attached to a lifting mechanism, comprised of:

a) an elongated body of refractory material that has a borehole positioned coaxialy with respect to the body of the stopper rod and adapted to receive fixedly a metal rod for its attachment to a lifting mechanism. The axial borehole of the body of refractory material has an enlarged part with an annular sealing surface spaced away from the upper end of the body of refractory material. The means for attachment of the metal rod are generally positioned between the enlarged part and the lower end of the body of refractory material. At its lower end, the body of refractory material may have means for introducing gas into the molten metal bath; and b) an elongated metal rod attached to the body of refractory material and having an axial borehole communicating in its lower part with the borehole of the body of refractory material. The rod has a collar carrying an annular sealing surface facing the annular sealing surface of the borehole of the body of refractory material to create a gas tight seal. The upper end of the rod is adapted to be attached to a lifting mechanism that permits displacing the stopper rod vertically inside of a pouring group such as a distributor.

The stopper rod is connected to a gas supply line, generally but not obligatorily, through the upper end of the rod. Means of attachment to the body of refractory material are generally positioned between the collar and the lower end of the metal rod. During the use of such a stopper rod, the gas introduced into the stopper rod is conveyed toward the axial borehole of the body of refractory material in its lower part. Thanks to the means for introducing gas into the molten metal bath that the body of refractory material has in its lower part, the stopper rod permits the introduction of gas into the molten metal bath. The facing annular sealing surfaces of the rod and the body of refractory material prevent significant losses of inert gas as well as the infiltration of air.

To improve this tightness even more, it was proposed to place a gas tight annular gasket between these sealing surfaces. The U.S. Pat. No. 4,946,083, for example, indicates that when a gasket with a thickness of ca. 0.4 mm and of material resistant to high temperatures, e.g., graphite, is in place, the interface between the annular sea surfaces of the rod and the body of refractory material furnishes tightness capable of resisting a pressure up to 3 bars.

The German patent DE-C1-4040189 discloses a stopper comprising an elongated refractory body having a) an axial borehole and means (locking pin) for attaching a metal rod, b) a metal rod and c) a sleeve like body compressing a sealing gasket under actuation of a nut.

With the device of this document, it is necessary to correct or fly tune the tightness when the mounting rod is fixed in the stopper body by screwing the nut against the upper end of the stopper. The system is not self-tightening and requires human intervention (screwing the nut) when the stopper has reached the final temperature. Such an intervention above the molten metal bath is uneasy and extremely dangerous. The seal is essential for casting high-grade molten metal. In the first place, it is necessary to assure a good protection against the filtration of air responsible for oxidizing the molten metal during pouring. On the other hand, it is also indispensable to minimize the losses of inert gas (in case an inert gas is injected through the stopper rod) that cause production cost overruns that are far from negligible. Beside this tightness issue, it is also essential that the attachment of the stopper rod to the mechanism remains as rig as possible.

The system in use at the present time still do not however furnish a completely satisfactory solution for these two points of view.

In conducting this research in this domain, the applicant discovered that these problems are due to the fact that Sealing gasket between the annular sealing surfaces of the rod and the body of refractory material facing each other does not remain compressed during the entire pouring operation.

It is believed that this loss of compression in the sealing gasket is due, at least partially, to the difference between the coefficients of thermal expansion of the different materials constituting the stopper rod. In particular, under the effect of the temperature to which the stopper rod is raised during pouring, the metal rod becomes highly dilated relative to the body of refractory material. This more substantial expansion of the metal rod has the effect of separating the annular sealing surfaces of the rod and the body of refractory material and consequently reducing the compression of the sealing gasket with all the adverse consequences involved.

According to the prevent invention, this problem is remedied by giving the stopper rod particular means for maintaining the compression of the sealing gasket in contact with the annular sealing sure of the body of refractory material when the stopper rod is brought to a high temperature. The stopper rod involved in the present patent application is, notwithstanding the means for maintaining the compression of the sealing gasket, similar to that described in U.S. Pat. Nos. 4,946,083 and 5,024,422 to which reference is made.

According to the invention, the means of maintaining the compression of the sealing surface when the stopper rod is brought to high temperature is furnished by a sleeve presenting the form of a cylinder open at its ends, which is fitted on the metal rod. The present invention concerns a one-piece stopper rod that can be attached to a lifting mechanism, comprised of:

an elongated body of refractory material, having (i) a borehole positioned coaxially with respect to the body and adapted to receive fixedly a metal rod for its attachment to a lifting mechanism, the axial borehole having an enlarged part that presents an annular sealing surface spaced away from the upper end of the body;

(ii) means for attaching the said metal rod;

an elongated metal rod fastened to the body adapted at its upper end to be attached to a lifting mechanism for vertically displacing the stopper rod inside of a pouring group; and a sleeve having a sealing surface at its lower end facing the sealing surface of the body, the stopper rod having means located on the metal rod for blocking the sleeve, the stopper being characterized in that the sleeve is formed of a material having a coefficient of thermal expansion greater than that of the metal rod and having a sufficient length so that, under the effect of the temperature to which the stopper rod is brought during pouring, the sleeve expand sufficiently to at least compensate for the effect of expansion of the metal rod.

According to a particular embodiment of the invention, the stopper rod can be connected to a gas supply line. Therefore, said elongated body of refractory material has, at its lower end, means for introducing gas into the molten metal bath and said metal rod has an axial borehole communicating in its lower part with the borehole of the body of refractory material.

Figure 1:
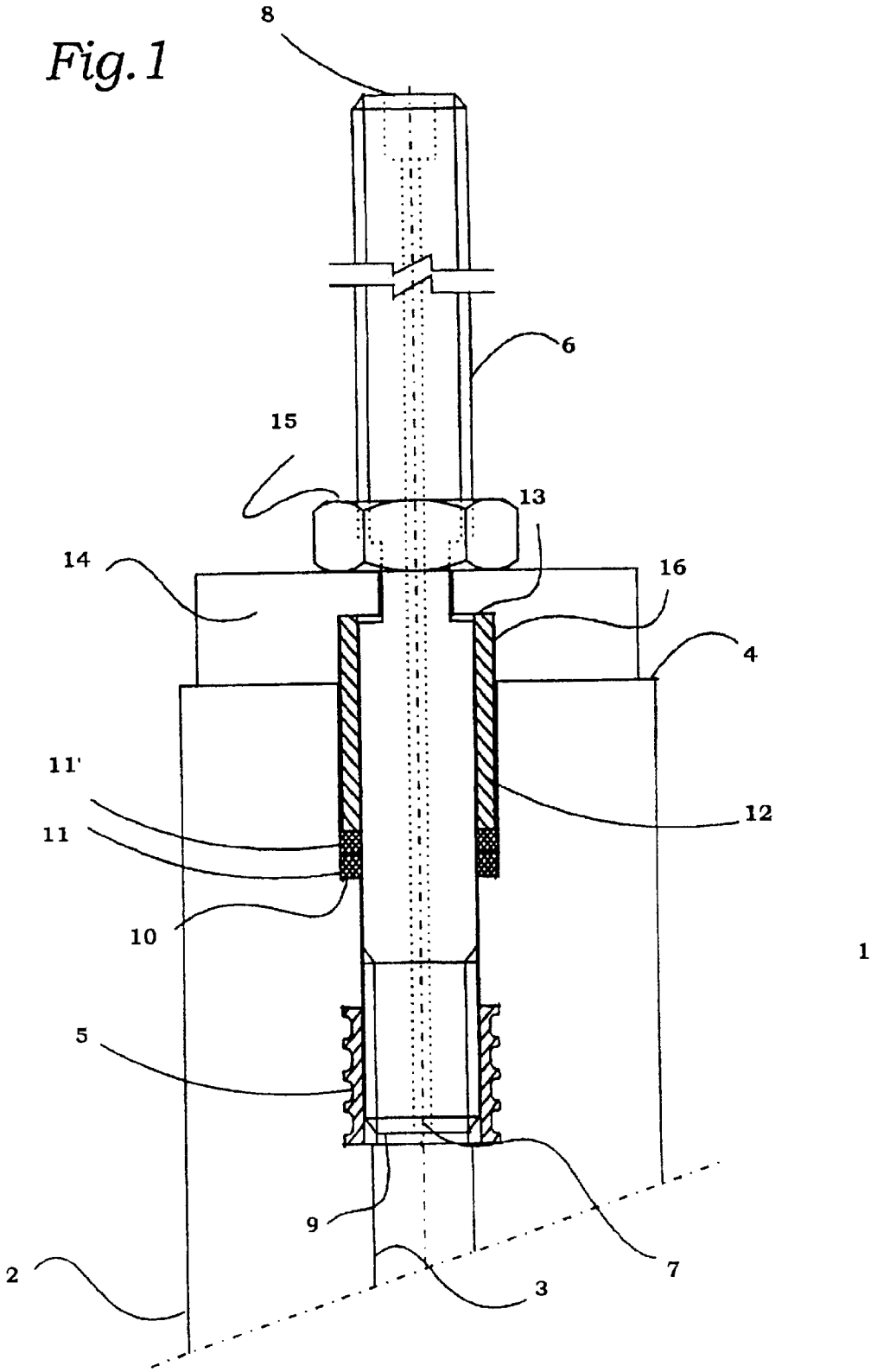
FIG. 1 is a fragmentary view in cross section of the upper end of a stopper rod according to a particular mode of implementing the invention.

On this FIGURE, the stopper rod 1 is comprised of an elongated body of refractory material 2 with an axial borehole 3 extending from its upper end 4 toward its lower end (not shown). At its lower end, the body of refractory material may or may not be provided with means for introducing inert gas (not shown) into the metal bath. The body of refractory material also has means 5 for attachment of a metal rod 6. The metal rod 6 also may have an axial borehole 7 that runs through it from its upper end 8 toward its lower end 9. The upper end 8 may be designed to receive a connector (not shown) for supplying an inert gas. Furthermore, the upper end 8 of the rod is adapted to be fixed to a lifting mechanism (not shown). A gas under pressure, such as argon, may be introduced into the axial borehole 3 of the body of refractory material by means of the rod 6 and is conveyed to the metal bath through the lower end of the body of refractory material.

The body of refractory material 2 has an enlarged part 10 that forms a sealing surface. Two graphite gaskets (11 and 11') rest on this sealing surface and thus prevent the infiltration of air or losses of inert gas. A sleeve 12 is fitted on the rod 6 and maintains the gaskets 11 and 11' under compression. The upper part 13 of the sleeve is blocked by a washer 14, itself retained by a nut 15.

Preferably, the washer 14 is in contact with the upper end 4 of the body of refractory material 2 in order to give the assembly an increased rigidity.

The sleeve 12 is comprised of a material having a coefficient of thermal expansion greater than that of the metal rod 6 and has a sufficient length so that under the effect of the temperature to which the stopper rod is brought during pouring it expands sufficiently toward the lower end of the metal rod to at least compensate for the effect of the expansion of the metal rod.

Preferably, the expansion of the sleeve compensates essentially precisely with the expansion of the metal rod.

As can be seen in FIG. 1, the sleeve 12 can project at the upper end 4 of the body of refractory material 2 if this is necessary to permit a sufficient length of the sleeve. In this case, a washer 14 provided with a shoulder 16 that permits blocking the sleeve 12 while assuring a contact between the washer 14 and the upper end 4 of the body of refractory material 2 is preferred.

The sleeve 12 is fitted on the metal rod 6 and forms with it a free assembly, turning, sliding or just sliding. The upper end 13 of the sleeve 12 just butts on the blocking means 14 and 15 located fixedly on the metal rod 6 so that, under the effect of expansion, the sleeve 12 is elongated anally only in the direction opposite the said blocking means.

According to one embodiment of the invention, the blocking means are comprised of a collar similar to that described in the U.S. Pat. Nos. 4,946,083 and 5,024,422, to which reference is made.

The material constituting the sleeve as well as its length are chosen as a function of the dimensions and the materials constituting the metal rod (generally machined from a bar of steel with a coefficient of thermal expansion of the order of 12.5 $\mu m° C^{-1}$) and the body of refractory material (typically comprised of a refractory material obtained by isostatic pressing with a coefficient of thermal expansion of 3–6 $\mu m° C^{-1}$).

The material constituting the sleeve as well as its length are easily determined from the basic principles of thermal physics.

Starting with the values thus determined in a first approximation and which generally furnish excellent results, it is then possible to optimize the system by trial an error without any difficulty.

According to the invention, the sleeve is comprised of a material with a high coefficient of thermal expansion capable of resisting the elevated temperatures to which the stopper rod is subjected during pouring. For example, refractory materials with a high coefficient of thermal expansion such as fritted magnesia can be used. The preferred materials for this application are found among metals or metal alloys with a high coefficient of thermal expansion and having a high melting point.

In general, a material having a coefficient of thermal expansion between 1.1 and 3 times that of the material of the steel rod is chosen for the sleeve.

Stainless steel (e.g., having a coefficient of thermal expansion of the order of 17.5 $\mu m° C^{-}$) is particularly appropriate when the metal rod is machined from a steel bar having a coefficient of thermal expansion of the order of 12 $\mu m° C^{-}$.

The body of refractory material is typically formed of a conventional refractory material such as a refractory material based on alumina silica graphite commonly used. A typical composition is, for example, in percentage by weight, $Al_2O_3$: 53%, $SiO_2$: 13%, carbon: 31% and about 3% of other materials such as zirconia $ZrO_2$, for example.

An annular gasket 11 that is gas-tight is preferably placed between the sealing surfaces. A gasket of graphite with a thickness between 0.2 and 30 mm is typically used.

According to the present invention, one or more conventional gaskets are used. The annular sealing gasket(s) are placed between the lower surface of the sleeve and the sealing surface of the body of refractory material.

The best results were observed when two graphite gaskets of 9 mm each were placed between the lower surface of the sleeve and the sealing surface of the body of refractory material.

According to a preferred form of implementing the invention, the sealing surface formed by the enlarged part 10 of the body of refractory material 2 as well as the sealing gasket(s) 11 (and 11') are flat. It was in fact found that in this case a much better preservation of the compression of the gasket(s) 11 (and 11') was obtained. In one implementation example, a body of refractory material obtained by isostatic pressing (coefficient of thermal expansion: 3.6 $\mu m° C_{-}$) each having a thickness of 9 mm. The metal rod is machined from a steel bar with a coefficient of thermal expansion of 12.5 $\mu m° C^{-1}$.

If a sleeve of stainless steel with a coefficient of thermal expansion of 17.5 $\mu m° C^{-1}$ is used, it is calculated that the sleeve should have a length of ca. 61 mm.

According to another embodiment of the invention, the means for maintaining the compression of the sealing gasket when the stopper rod is brought to a high temperature are furnished by positioning the fixation point of the metal rod to the body of refractory material at a point situated between the sealing surface and the upper part of the rod. In this case, more important is the expansion, more the sealing gasket is compressed by the metal rod that expands under the effect of the temperature to which the stopper rod is brought during pouring.

According to a particular form of implementing the invention, the stopper rod also has means for preventing the metal rod from separating from the body of refractory material. Thus, if a metal insert having a threaded axial internal borehole anchored in the body of refractory material was used as the means of fixation of the rod to the body of refractory material, the rod will be prevented from becoming unscrewed from the insert by furnishing it with a pair of parallel plane surfaces at the point of emergence from the body of refractory material and by supporting on these plane surfaces an integral forked flange joined fixedly to the body of refractory material. This fixed joint can be realized by a pin inserted in a shaft effected through the forked flange and extending into the body of refractory material. In this case, the washer according to the present invention can advantageously also play the role of the forked flange.

According to another particular embodiment of the invention, the body of refractory material of the stopper rod is comprised at least partially of a refractory material relatively impermeable to gases. Quite particularly, the body of refractory material is comprised of at least two different refractory materials, a first part comprised of a mixture relatively impermeable to the gases substantially surrounding the region in which the sealing gasket is positioned and a second part comprised of a refractory material resistant to corrosion by molten metals.

What is claimed is:

1. A stopper rod for use in the casting of molten metal comprising:

a) an elongated body of refractory material having a lower end, an upper end, a longitudinal axis extending between the lower and upper ends, an inner surface open to the upper end and defining a borehole along the longitudinal axis, the borehole having an enlarged portion comprising an annular sealing surface spaced away from upper end, and a fastener within the borehole spaced further from the upper end than the annular sealing surface;

b) a metal rod comprising a first material having a first coefficient of thermal expansion, a first end, and a second end, the first end fixedly secured to the fastener, and the second end adapted to be attached to a lifting mechanism capable of vertically displacing the stopper rod inside of a casting vessel;

c) a blocking device attached to the metal rod and contacting the upper end of the body; and d) a sleeve comprising a second material having a second coefficient of thermal expansion greater than the first coefficient of thermal expansion, the sleeve having a second sealing surface cooperating with the annular sealing surface, the sleeve secured against the annular sealing surface by the blocking device, and having a length at least sufficient to compensate for thermal expansion of the metal rod during casting.

2. The stopper rod according to claim 1, wherein the stopper comprises at least one annular sealing gasket in contact with the annular sealing surface.

3. The stopper rod according to claim 2, wherein the annular sealing gasket and the annular sealing surface are flat.

4. The stopper rod according to claim 1, wherein the metal rod has an inner surface defining a throughbore between the first and second ends, and the throughbore at the first end fluidly communicates with the borehole of the body.

5. The stopper rod according to claim 1, wherein the lower end of the body comprises a gas injector for introducing gas into the molten metal.

6. The stopper rod according to claim 1, wherein the sleeve projects beyond the upper end of the body.

7. The stopper rod according to claim 1, wherein the second coefficient of thermal expansion is from 1.1 and 3 times that of the first coefficient of thermal expansion.

8. The stopper rod according to claim 1, wherein the second material comprises stainless steel, the first material comprises steel, and the body is formed by isostatic pressing.

9. The stopper rod according to claim 1, wherein the blocking device comprises a collar.

10. The stopper rod according to claim 1, wherein the blocking device comprises a nut threaded on the metal rod.

11. The stopper rod according to claim 1, wherein the blocking device comprises at least one washer.

12. The stopper rod according to claim 11, wherein the washer comprises an internal shoulder so that the sleeve can project beyond the upper end of the body while the washer contacts the upper end of the body.

13. The stopper rod according to claim 12, wherein the stopper comprises a secondary fastener that prevents the metal rod from separating from the body.

14. A stopper rod for use in the casting of molten metal comprising:

a) an elongated body of refractory material having a lower end, an upper end, a longitudinal axis extending between the lower and upper ends, an inner surface open to the upper end and defining a borehole along the longitudinal axis, the borehole having an enlarged portion comprising an annular sealing surface spaced away from upper end, and a fastener within the borehole spaced further from the upper end than the annular sealing surface;

b) a metal rod comprising a first material having a first coefficient of thermal expansion, a first end, and a second end, the first end fixedly secured to the fastener, and the second end adapted to be attached to a lifting mechanism capable of vertically displacing the stopper rod inside of a casting vessel;

c) a blocking device comprising a nut and a washer, the nut being fixedly secured to the metal rod and securing the washer against upper surface of the body;

d) at least one annular sealing gasket contacting the annular sealing surface; and e) a sleeve comprising a second material having a second coefficient of thermal expansion greater than the first coefficient of thermal expansion, the sleeve having a second sealing surface cooperating with the annular sealing gasket, the sleeve secured against the annular sealing gasket by the blocking device, and having a length at least sufficient to compensate for thermal expansion of the metal rod during casting.

15. The stopper rod according to claim 14, wherein the washer comprises an internal shoulder so that the sleeve can project beyond the upper end of the body.

* * * * *